United States Patent [19]

Stuart

[11] Patent Number: 4,858,913

[45] Date of Patent: Aug. 22, 1989

[54] AQUATIC EXERCISING AID

[76] Inventor: Craig J. Stuart, 4105 Fox Hollow Rd., Eugene, Oreg. 97405

[21] Appl. No.: 187,852

[22] Filed: Apr. 29, 1988

Related U.S. Application Data

[63] Continuation-in-part of Ser. No. 22,080, Mar. 5, 1987, abandoned.

[51] Int. Cl.[4] ..... A63B 69/00

[52] U.S. Cl. ..... 272/71; 434/254; 441/60

[58] Field of Search ..... 272/1 B, 71, 116, 119, 272/130; 434/254; 441/60, 59

[56] References Cited

U.S. PATENT DOCUMENTS

| | | | |
|---|---|---|---|
| 1,622,914 | 3/1927 | Kindt | 441/60 |
| 3,114,982 | 12/1963 | McGowan | 272/119 X |
| 3,170,175 | 2/1965 | Brandt | 441/60 |
| 3,306,610 | 2/1967 | Biggs, Jr. et al. | 272/119 |
| 3,334,898 | 8/1967 | McCrort et al. | 272/119 |
| 4,239,211 | 12/1980 | Wilkerson | 272/119 |
| 4,258,914 | 3/1981 | Lalli | 272/119 X |
| 4,300,759 | 11/1981 | Caplan | 272/130 X |
| 4,384,714 | 5/1983 | Kimura | 272/119 |
| 4,671,507 | 6/1987 | Huttner | 272/71 |

OTHER PUBLICATIONS

Advertisement for "Giant Inflatable Feet", The New York Times, Jun. 11, 1972.

Advertisement for AMF's "Aquatic Exercise Program", 1980.

*Primary Examiner*—Richard J. Apley

*Assistant Examiner*—Robert W. Bahr

*Attorney, Agent, or Firm*—James D. Givnan, Jr.

[57] ABSTRACT

A buoyant device for attachment to the lower leg and ankle with strap components holding the device in place. Buoyant main body members are confined within an enclosure having a zipper closure. Buoyant inserts may be selectively removed from or added to the main body members to vary the buoyancy of the aid. Large, upright surface areas of the aid resist passage through the water and hence require muscular effort on the user's part.

4 Claims, 1 Drawing Sheet

AQUATIC EXERCISING AID

The present application is a continuation-in-part of my earlier filed, copending application Ser. No. 022,080 filed Mar. 5, 1987, now abandoned, and having the same title.

BACKGROUND OF THE INVENTION

The present aid or device concerns generally flotation devices attachable to the human body.

It is now widely accepted that aquatic exercises are both beneficial to the individual while avoiding risk of injury common to other forms of exercise particularly jogging. While jogging is highly suitable for those in good physical condition, it does constitute a source of injury to older persons and those in less than optimum physical condition. It is not uncommon for runners and joggers to experience various muscle, tendon and bone disorders resulting from forces generated by the foot impacting a ground surface.

Aquatic exercises have been utilized for many years and are particularly suited to those individuals where a modest amount of exercise is desirable which group may include those individuals experiencing various leg and foot problems.

A problem with aquatic exercise is that pool facilities are limited and only certain depths of a swimming pool may be utilized at least for non-swimmers. Accordingly, limited use of a pool facility results in the cost of pool use for an exercise class being apportioned over relatively few participants to render the cost per person objectionable. Further, non-swimmers are prevented from participating in leg exercises which ideally are conducted in the deep end of the pool.

In the prior art are exercising devices with removable inserts such as a flexible cuff shown in U.S. Pat. No. 4,384,714 while U.S. Pat. Nos. 3,334,898; 3,114,982; 3,306,610; 3,170,175 show footwear or ankle attached exercising devices which for the most part are not suitable for aquatic use.

SUMMARY OF THE INVENTION

The present invention is embodied within a flotation device attachable about the ankle and lower leg of the user.

The present flotation device, in addition to providing a degree of buoyancy, requires that the wearer exert muscular effort and control to maintaining his or her legs directly below the torso which effort requires exercising of the arms as well as the legs. Further, the device offers resistance to leg movement through the water by reason of drag induced on the upright surface of the device by the water.

The device includes a provision enabling the buoyancy of same to be varied to best suit the user's objectives. Decreasing the buoyancy of the device reduces the amount of effort required to keep the device submerged below the torso and, conversely increasing the buoyancy of the device requires a more strenuous effort to keep the device submerged. A cover or enclosure of the device permits access to a buoyant member or members for the purpose of altering their buoyancy.

Important objectives include the provision of a flotation device which additionally imparts drag on the leg as it moves through the water for the purpose of performing aquatic exercises; the provision of a flotation device which permits the user to readily alter the buoyancy of same to best accomplish the user's personal exercise objectives; the provision of a flotation device which permits non-swimmers to participate in aquatic exercises in that portion of a swimming pool normally unusable to non-swimmers; the provision of a flotation device having strap and buckle components which permit a pair of the devices to be coupled to one another so as to function as a flotation belt.

DETAILED DESCRIPTION OF THE PREFERRED EMBODIMENTS

Figure 1:
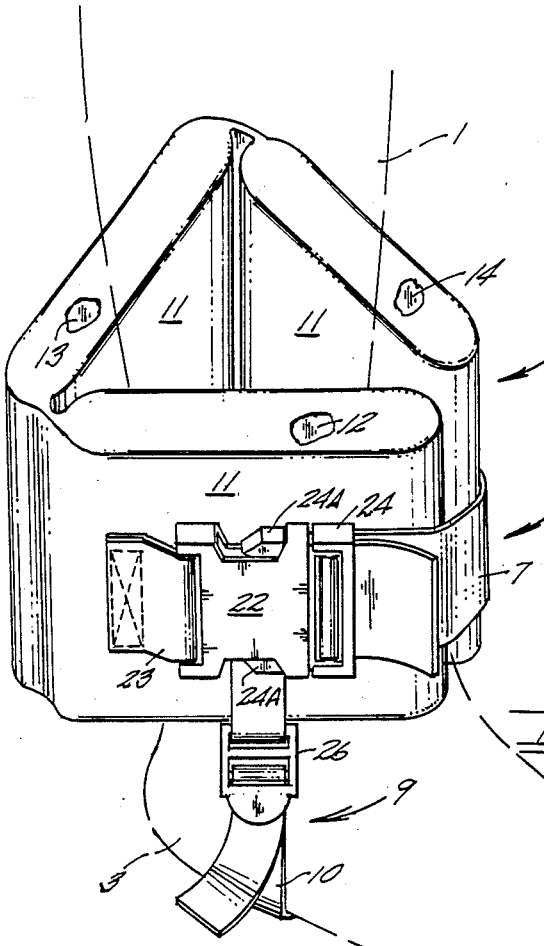
FIG. 1 is a downward perspective view of the present device operatively disposed with the lower leg and foot shown in phantom lines.

With continuing attention to the drawings wherein applied reference numerals indicate parts similarly hereinafter identified, the reference numeral 1 indicates the lower leg of the user with the user's foot instep indicated at 2 and heel at 3.

Indicated generally at 5 is the main body of the flotation device. Retention means generally at 6 includes a strap 7 which holds the main body closed about the lower leg 1 and the user's ankle.

The flotation device is restrained against upward displacement, when submerged, by restraint means generally at 9 and includes strap extending beneath the wearer's heel, and thence terminating upwardly in attachment to the main body as later described.

The main body of the flotation device is adapted for closure about the lower leg and ankle. Toward this end the main body may be of segmented construction with a pliable enclosure 11 provided in the form of a fabric belt. Main body members at 12, 13 and 14 within the enclosure are of a buoyant nature and may be constructed from polyethylene foam providing rigid body members. The foamed blocks of material have upright outer planar surfaces to provide resistance to passage through water.

Enclosure 11 is shown as being of porous fabric construction having a closure in the form of zipper 15 with pull 15A in place along an enclosure surface at 11A. The zipper permits access to spaced apart compartments partially defined by lines of stitching at 16, 17, 18 and 19. The partial lines of stitching permit ease of zipper operation by permitting the zipper carrying surface 11A to be planar or flat. The spaced apart compartments facilitate placement of the aid about the ankle.

Preferably the buoyant members 12, 13 and 14 include buoyant inserts as at 20 in frictional engagement with the major portion of the buoyant member which permits insert removal to reduce buoyancy of the device. The buoyant members may each define multiple bores or receptacles as at 21 for frictional insert reception.

Figure 2:
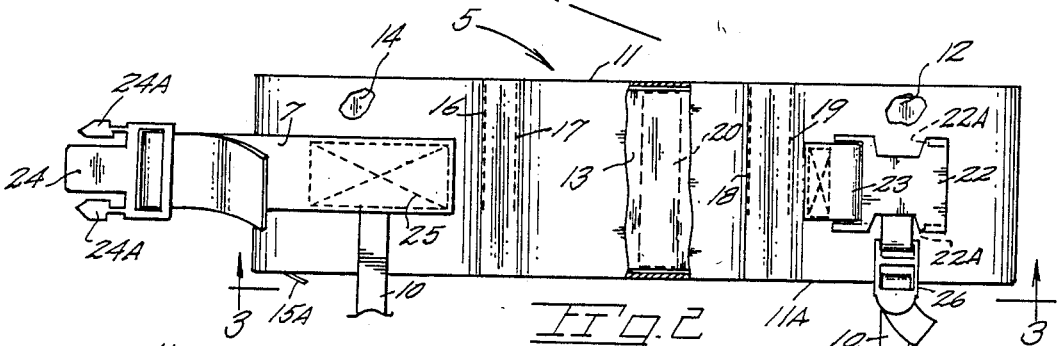
FIG. 2 is an elevational view of the device shown in open configuration.
Figure 3:
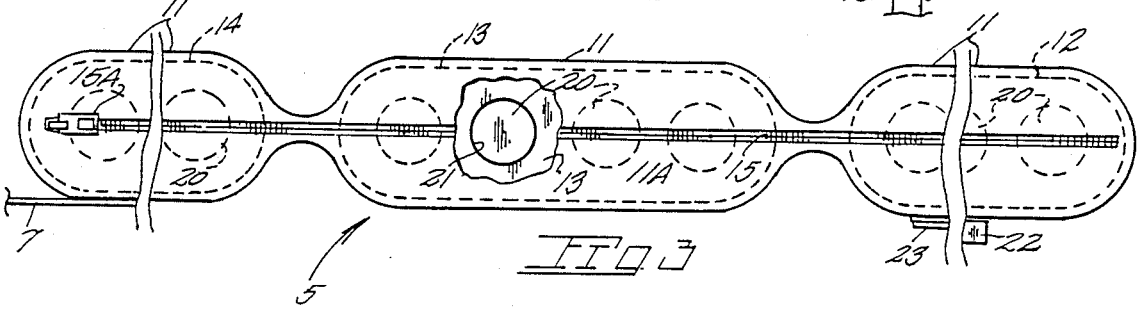
FIG. 3 is a bottom plan view of the device taken along line 3–3 of FIG. 2 and on an enlarged scale and with fragments removed.

Retention means 6 includes strap 7 while a buckle arrangement at 22 is attached with a short length of doubled strap at 23 (FIG. 2) stitched to enclosure 11. A buckle insert at 24 is carried by retention strap 7 which is stitched at 25 to the enclosure. The buckle 22 and insert 24 are shown as of the type having insertable flexible arms 24A which automatically lockingly engage abutments as at 22A on the buckle with convenient insert release accomplished by inward displacement of arms 24A by fingertip pressure.

Restraint means 9 additionally includes a buckle at 26 to permit convenient height adjustment of the device so as to retain the lower edge of same against the foot of the user. Restraint strap 10 passes under the foot of the rearward portion of the foot arch to prevent accidental rearward strap dislodgment from the foot.

In use, the device is snugly applied about the ankle with restraint means 9 preventing upward displacement by the water. Movement of the legs through the water is restricted by the drag induced by water acting on the upright outer surfaces of each of the buoyant members of the device. Addition or removal of inserts does not alter drag resulting from water impacting these surfaces. Further, as the device is highly buoyant, it requires the wearer exert arm and leg effort to keep the legs submerged below the torso. The added buoyancy of the device renders the human body buoyant permitting non-swimmers use of the deeper end of a swimming pool. As enclosure 11 is porous, removal of inserts permits water to fill the void left by the inserts to effectively reduce buoyancy of the aid.

Figure 5:
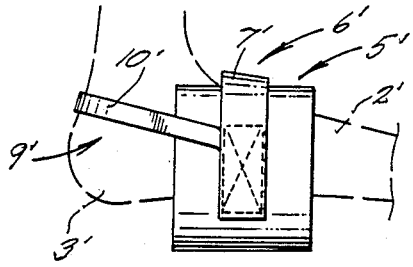
Figure 4:
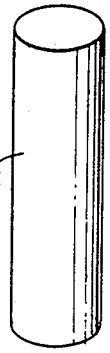
FIG. 4 is a perspective view of an insert removed from a buoyant member.

In FIG. 5, an aid at 5' is shown in place about the foot with retention means generally at 6' extending over instep 2' of the foot and restraint means generally at 9' extending about the heel 3'. This disposition of the aid or device incurs increased drag on vertical leg motion of interest to those exercising certain leg muscles. The modified form of the device may include elastic straps at 7' and 10' stitched at their ends to main body 5'. The modified form is also suitable for use as shown in FIG. 1.

While I have shown but a few embodiments of the invention, it will be apparent to those skilled in the art that the invention may be embodied still otherwise without departing from the spirit and scope of the invention.

Having thus described the invention, what is desired to be secured by a Letters Patent is:

I claim:

1. An aquatic exercise aid for attachment to the human body, said aid comprising, a main body of a buoyant nature including rigid multiple buoyant block members of foamed material, at least some of said block members defining receptacles, buoyant inserts for selective installation into said receptacles to vary the buoyancy of the main body, an enclosure of a permeable nature for placement about the ankle and including compartments offset from one another, each compartment receiving one of said buoyant block members, said enclosure having a flat surface, a closure in place on said flat surface and permitting access to said compartments, retention means carried by said enclosure for holding same in substantially closed configuration to define a central open area within which a portion of the human body is received, and adjustable restraint means on said enclosure also for engagement with the human body to restrain the aid against buoyant displacement relative the human body.

2. The aid claimed in claim 1 wherein said buoyant block members each have a substantially upright planar surface which is outwardly disposed relative the body to impede aid passage through water, said planar surface not altered by presence or absence of said inserts.

3. An aquatic exercise aid for attachment to the ankle and lower leg of an upright user, said aid comprising, a main body including rigid multiple buoyant members of foamed construction defining multiple bores and each of said members having a planar upright outer surface acted on by the water to impede aid passage through the water and hence leg movement through the water, inserts in at least some of said bores of said buoyant members, an enclosure of a permeable nature and including compartments for said body members, a flat surface on said enclosure including a closure substantially coextensive with said surface permitting access to said compartments and said members for insert removal or installation, retention means carried by said enclosure for holding same in substantially closed configuration to define a central open area within which the lower leg is received, restraint means on said enclosure for engagement with the underside of the wearer's foot to restrain the aid against buoyant displacement, water acting on said enclosure and said upright surface of each of said buoyant members requiring muscular effort for passage through water, and varying of the buoyancy of the aid by the removal or addition of said inserts additionally contributing to the muscular effort required to keep the aid submerged and the user upright.

4. The aid claimed in claim 3 wherein said restraint means includes a strap and a buckle in adjustable engagement with one another.

* * * * *